US005760757A

United States Patent [19]

Tanaka et al.

[11] Patent Number: 5,760,757

[45] Date of Patent: Jun. 2, 1998

[54] NEGATIVE FEEBACK CONTROL OF DUMMY ROW ELECTRODES TO REDUCE CROSSTALK AND DISTORTION IN SCAN ELECTRODES INDUCED BY SIGNAL ELECTRODE FLUCTUATIONS

[75] Inventors: Shinichi Tanaka, Ibaraki-ken; Fujihiko Sugihashi, Kashiwa; Takeshi Nosaka, Tsuchiura, all of Japan

[73] Assignee: Texas Instruments Incorporated, Dallas, Tex.

[21] Appl. No.: 525,331

[22] Filed: Sep. 8, 1995

[30] Foreign Application Priority Data

Sep. 8, 1994 [JP] Japan ..... 6-240632

[51] Int. Cl.[6] ..... G09G 3/36

[52] U.S. Cl. ..... 345/93

[58] Field of Search ..... 345/93, 58, 94–97

[56] References Cited

U.S. PATENT DOCUMENTS 5,434,599 7/1995 Hirai et al. ..... 345/94

5,489,910 2/1996 Kuwata et al. ..... 345/96

5,576,729 11/1996 Yamazaki ..... 345/94

*Primary Examiner*—Mark R. Powell

*Attorney, Agent, or Firm*—Richard L. Donaldson; William B. Kempler

[57] ABSTRACT

To eliminate or suppress the effect of inductance from changes in signal electrode potential on scan electrode potential due to liquid crystal static capacitance, dummy electrodes DH, DM, and DL have virtually the same construction as a scan electrode X, and are crossed with signal electrodes Y1~YM, sandwiching the liquid crystal. The output terminals of operational amplifiers 20, 22, and 24 are respectively coupled to dummy electrodes DH, DM, and DL through output buffer transistors 26H, 26M, and 26L, while at the same time being coupled to each scan electrode $X_i$ through output buffer transistor 28H(i), 28M(i), and 28L(i). Dummy electrodes DH, DM, and DL are respectively coupled to the inverting input terminals of operational amplifiers 20, 22, and 24.

3 Claims, 9 Drawing Sheets

Y1
Y2
Y3
DM
DH
DL
X1
26H
26M
26L
28H(1)
28M(1)
28L(1)
<VH>
<VM>
<VL>
20
22
24
[VH]
[VM]
[VL]

NEGATIVE FEEBACK CONTROL OF DUMMY ROW ELECTRODES TO REDUCE CROSSTALK AND DISTORTION IN SCAN ELECTRODES INDUCED BY SIGNAL ELECTRODE FLUCTUATIONS

FIELD OF THE INVENTION

The present invention relates to a drive apparatus for driving an LCD panel.

BACKGROUND OF THE INVENTION

In recent years, flat panel displays have been used as a display apparatus for computers, etc. There are various types of flat panel displays; LCDs (liquid crystal displays) employing liquid crystals are widely used, and simple matrix LCD panels are representative thereof.

In LCD panels of this type, when the signal electrode Y voltage changes, the scan electrode X voltage is subjected to inductance from the signal voltage waveform due to static capacitance of the liquid crystal. In the FIG. 10 drive circuit, the output voltage of output buffer 108 is supplied by scan electrode X in an open loop, so that when distortion is generated in the scan electrode X voltage by inductance from the signal electrode Y signal voltage waveform, that distortion voltage is expressed in the scan voltage waveform without being suppressed in any way.

SUMMARY OF INVENTION

To achieve the above object, the first LCD panel drive apparatus of the present invention is formed as follows: in an LCD panel drive apparatus for driving an LCD panel formed such that multiple scan electrodes and multiple signal electrodes are arrayed in an intersecting matrix so as to sandwich the liquid crystal, and pixels located at each point of intersection are ON or OFF in accordance with the absolute value of the difference between the voltages applied respectively to the scan electrode and the signal electrode, the present invention is an LCD panel drive apparatus with an operational amplifier connected to the scan electrode through a first output buffer transistor; the non-inverting input terminal of the operational amplifier receives a reference voltage which determines the voltage level applied to the scan electrode, and the output terminal of the operational amplifier has a switching function; dummy electrodes which intersect the multiple signal electrodes arrayed so as to sandwich them and in parallel to the scan electrodes, and connected to the inverting input terminal of the operational amplifier and to the operational amplifier output terminal through a second output buffer transistor, which is effectively equivalent to the first output buffer transistor and is in a constant ON state.

FIG. 8 schematically shows a simple matrix panel. This simple matrix LCD panel has a structure in which liquid crystal is sandwiched by multiple scan electrodes X1, X2, . . . , XN and multiple signal electrodes Y1, Y2, . . . , YM, and the intersections of scan electrodes X and signal electrodes Y constitute the individual pixels.

In the LCD panel, a screen is formed by transmitting the display signals to each pixel by scan driving (time-division driving). In other words, a line is displayed by application of a selecting scan voltage to one scan electrode $X_i$ at a time and sending the applicable display signal (selecting signal voltage or non-selecting signal voltage) from each of the signal electrodes Y1, Y2, . . . YM to each pixel (pixels on the selected line) on the scan electrode $X_i$. Scan electrodes are selected or scanned in order from the top (in the order X1, X2, . . . XN), thus forming a single frame (screen) in one cycle.

In the past, the six level drive method has been used to drive this type of LCD panel. The six level drive method is here explained with reference to the voltage waveform in FIG. 9. To simplify the explanation, we assume that the LCD panel display is a binary ON/OFF (white/black) display.

Liquid crystal material degrades immediately when driven by direct current as ions accumulate on one side; alternating current drive is required to prevent this. For this reason, as shown in FIG. 9(*a*), there are two scan electrode X non-selecting scan voltages: V6 (for example, 2.5V) and V5 (for example, 27.5V) and two selecting voltages V1 (for example, 30V) and V2 (for example, 0V). As is shown in FIGS. 9(*b*) and (*c*), there are two signal electrode Y non-selecting (pixel OFF) voltages: V4 (for example, 0V) and V3 (for example, 25V) and two selecting voltages: (pixel ON) V2 (for example 0V) and V1 (30V). ON/OFF control of each pixel is implemented by combinations of the above-described voltages.

The signal electrode Y selecting voltage is V2 (0V) when the scan electrode X selecting scan voltage is V1 (30V); the signal electrode Y selecting signal voltage is V2 (0V) when the scan electrode X selecting scan voltage is V1 (30V), and therefore a VON (30V) voltage is applied to the pixel located at the intersection of that scan electrode X and signal electrode Y and the relevant pixel turns on. Meanwhile, the selecting signal electrode Y non-selecting signal voltage is V4 (5V) when scan electrode X selecting scan voltage is V1 (30V), and the signal electrode Y non-selecting signal voltage is V3 (25V) when the scan electrode X selecting scan voltage is V2 (0V); a voltage VOFF (25V) is applied to the corresponding pixel, and the applicable pixel turns off.

V2 (0V) or V4 (5V) is applied at each signal electrode Y when the non-selecting scan voltage V6 (25V) is applied to each scan electrode X, and V3 (25V) or V1 (30V) is applied at each signal electrode Y when the non-selecting scan voltage V5 (27.5V) is applied to each scan electrode X, such that a voltage of 2.5V is applied to each pixel on each non-selecting scan electrode X, so that an OFF state is retained at each relevant pixel.

FIG. 10 shows a standard conventional drive circuit used to drive each scan electrode $X_i$. In this drive circuit, the output terminals of the four voltage followers 100, 102, 104, and 106—made up of operational amplifiers— are connected to one end of scan electrode $X_i$ through output buffer 108. In the above described six level drive method, the four voltages V1 (30V), V5 (27.5V), V6 (5V), and V2 (0V) are respectively applied to the input terminals of voltage followers 100, 102, 104, and 106.

One terminal of output buffers 108 (for example, the source terminal) is connected in a one-to-one relationship with the output terminals of voltage followers 100, 102, 104, 106, and the other terminal (for example, the drain terminal) is connected in common to scan electrode $X_i$; control terminals (for example, gate terminals) are formed of 4 individual or 4 sets of buffer transistors 108A, 108B, 108C, and 108D connected to a control circuit (not shown). As shown in the diagram, when only buffer transistor 108B is ON and the other buffer transistors 108A, 108C, and 108D are OFF, the voltage V5 from voltage follower 102 is applied to scan electrode $X_i$ through buffer transistor 108B.

FIG. 11 shows another conventional drive circuit used to drive scan electrode $X_i$. With this drive circuit, the voltage followers 100, 102, 104, and 106 in FIG. 10 described above are replaced by operational amplifiers 110, 112, 114, and 116 respectively, and scan electrode $X_i$ is connected to the inverting input terminals of each operational amplifier 110~116 through capacitor 118. RC circuits 120, 122, 124, and 126 are inserted between capacitor 118 and the inverting inputs of each operational amplifier for adjusting the phase and level of the negative feedback signal. When distortion occurs in the scan electrode $X_i$ drive voltage waveform, that distortion voltage is detected at capacitor 118 and negatively fed back to each operational amplifier 110~16, thereby automatically suppressing the distortion voltage generated on scan electrode $X_i$.

In regard to this point, the scan electrode X voltage fluctuation in the FIG. 11 drive circuit is negatively fed back to the inputs of each operational amplifier 110~116 through capacitor 118, so that when scan electrode X receives inductance from the signal electrode Y signal voltage waveform, each of the operational amplifiers 110~116 acts to suppress that induced voltage (distortion voltage). However, the negative feedback signal supplied to the inputs of operational amplifiers 110~116 from capacitor 118 through RC circuits 120~126 does not accurately (faithfully) represent the scan electrode X voltage fluctuation, so there is a limit to the accuracy of feedback control, and it is difficult to effectively suppress distortion voltages.

The particular problem caused by inductance from the signal voltage waveform with respect to scan electrode potential due to the above-described liquid crystal static capacitance coupling is the crosstalk which occurs when the rise or fall of the scan selecting voltage and logical inversion of the signal voltage waveform coincide in time. For example, in a display pattern containing a square black block-shaped area B in the middle of the screen, as shown in FIG. 12, horizontal crosstalk brighter than the perimeter occurs in the left and right side white areas W in black block area B around the upper edge of black block area B (G), and horizontal crosstalk which is darker than the perimeter occurs around the lower edge portion of black block area B (H).

FIG. 13 shows the reason for the occurrence of dark crosstalk in the white area (H). In FIG. 13, (a) is the signal electrode Yi signal voltage waveform which vertically divides black block B; (b) is the scan electrode $X_i$ scan voltage waveform located at the very bottom within black block B; (c) is the scan $X_{i+1}$ scan voltage waveform located directly below scan electrode $X_i$ outside of black block B; (d) is the scan electrode $X_{i+2}$ scan voltage waveform directly below scan electrode $X_{i+1}$.

When the selecting scan electrode is switched over to scan electrode $X_{i+1}$ from $X_i$, to which selecting scan voltage (V1) is applied at the bottom edge of black block B, signal electrode Yj signal voltage simultaneously falls from black level V4 to white level V2. This signal voltage waveform fall (logical inversion) effects a scan electrode $X_i$ selecting scan voltage fall and a scan electrode $X_{i+1}$ selecting scan voltage rise by induction through liquid crystal static capacitance; the selecting scan voltage waveform fall has a steep slope in the same direction as the signal voltage waveform and the induction; the selecting scan voltage waveform rise is affected since the direction of inductance is opposite that of the signal voltage waveform, and the effective value of each voltage decreases.

As a result, the voltages applied to the white pixels on scan electrode $X_i$ and $X_{i+1}$ are relatively reduced, and two scan lines of dark crosstalk appear in the white area (H). In the white area (G), because of the reversal in signal voltage logic value of the two continuous selecting scan voltages synchronized with the logical inversion of this signal voltage waveform, the falling voltage is affected due to the fact that the signal voltage waveform and the inductance go in opposite directions, while with the rising voltage, inductance has the same direction as the signal voltage waveform, so that the slope is steep; in both the effective voltage value rises, and two scan lines of bright crosstalk appear as a result.

In FIG. 13, (b)r and (b)f are respectively the scan electrode $X_i$ scan voltage rise time and fall time; (c)r and (c)f are respectively the scan electrode $X_{i+1}$ scan voltage rise time and fall time; (d)r and (d)f are respectively the scan electrode $X_{i+2}$ scan voltage rise time and fall time, and the following inequalities obtain: (c)r>(d)r=(b)r; (b)f<(d)f=(c)f. In FIG. 13, scan electrode scan voltage rise times and fall times are exaggerated over actual values.

The present invention was undertaken in light of these problems. Its object is to provide an LCD panel drive apparatus which effectively eliminates or suppresses the effects of inductance caused in the scan electrode voltage by changes in the signal electrode voltage due to static capacitance in the liquid crystal.

The second LCD panel drive apparatus of the present invention is formed as follows: in the first LCD panel drive apparatus described above, wherein if the number of voltage levels applied selectively to the scan electrodes is N (N is an integer), N rows of the operational amplifiers, the second output buffer transistors and the dummy electrodes are respectively provided, and N rows of the output buffer transistors are provided for each of the scan electrodes, and the first output buffer transistors and the second output buffer transistors connected in common to the output terminals of each of the operational amplifiers are effectively equivalent to one another.

The third LCD panel drive apparatus of the present invention is formed as follows: in the first and second LCD panel drive apparatus described above, the dummy electrodes have virtually the same construction as the scan electrodes, and are arrayed on the outside of the LCD panel video display area.

The fourth LCD panel drive apparatus of the present invention is formed as follows: in an LCD panel drive apparatus for driving an LCD panel formed such that multiple scan electrodes and multiple signal electrodes are arrayed in an intersecting matrix so as to sandwich the liquid crystal, and pixels located at each point of intersection are ON or OFF in accordance with the absolute value of the difference between the voltages applied respectively to the scan electrode and the signal electrode, the present invention is an LCD panel drive apparatus with a scan electrode drive means which applies a selecting scan voltage to at least one of the scan electrodes at a fixed selected interval, while at the same time applying a non-selecting scan voltage to all other of the scan electrodes; a signal electrode drive means which applies to each of the signal electrodes a signal voltage based on the pixel data for each pixel on the scan electrodes, to which are applied the selecting scan voltages at the selected interval; and an applied voltage timing control means which offsets by a specified time the timing at which the selecting scan voltage rises and falls at the start and termination of the selected interval and the timing at which the signal voltage logic value changes.

The present invention provides dummy electrodes which are electrically equivalent to the scan electrodes; that is to say they are equivalent with respect to their static capacitance coupling with the signal electrode and their applied voltage levels and buffer transistor impedances. Fluctuations in the signal electrode signal voltage cause the same inductance on the dummy electrode as on the scan electrode due to static capacitance in the liquid crystal. The inductance effect in the dummy electrode is negatively fed back to the operational amplifier, and the operational amplifier acts to cancel that inductance component, so inductance at the scan electrode is reliably suppressed.

Also, in the present invention an applied voltage timing control means offsets by a specified time the selecting scan voltage rise and fall timing at the beginning and end of the selected interval, and the timing by which the signal voltage local value changes, so the effect of inductance caused by logical inversion of the signal voltage waveform on the selecting scan voltage rise and fall disappears, and crosstalk is effectively suppressed.

Figure 1:
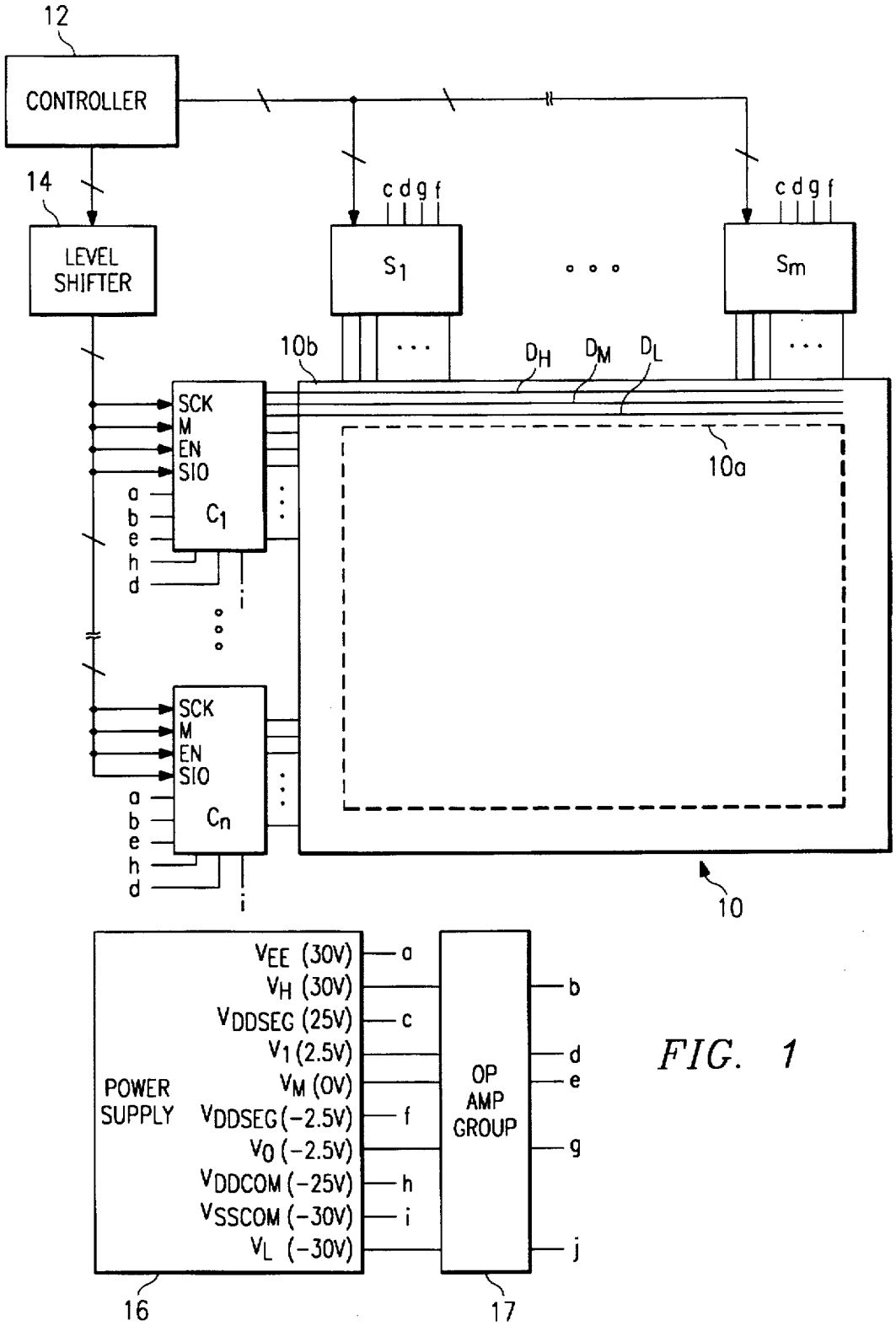
FIG. 1 is a block diagram of a liquid crystal display apparatus using the LCD panel drive apparatus of one embodiment of the present invention.

In the figures the following parts are: a simple matrix LCD panel 10, a controller 12, level shifter 14, power supply circuit 16, operational amplifier group 17, operational amplifiers 20, 22, 24, output buffer transistors 26H, 26M, 26L, output buffer transistors 28H(i), 28M(i), 28L(i), dummy electrodes DH, DM, DL, scan electrodes X1, X2, . . . . XN, and signal electrodes Y1, Y2, . . . . YM.

DESCRIPTION OF EMBODIMENTS

Figure 8:
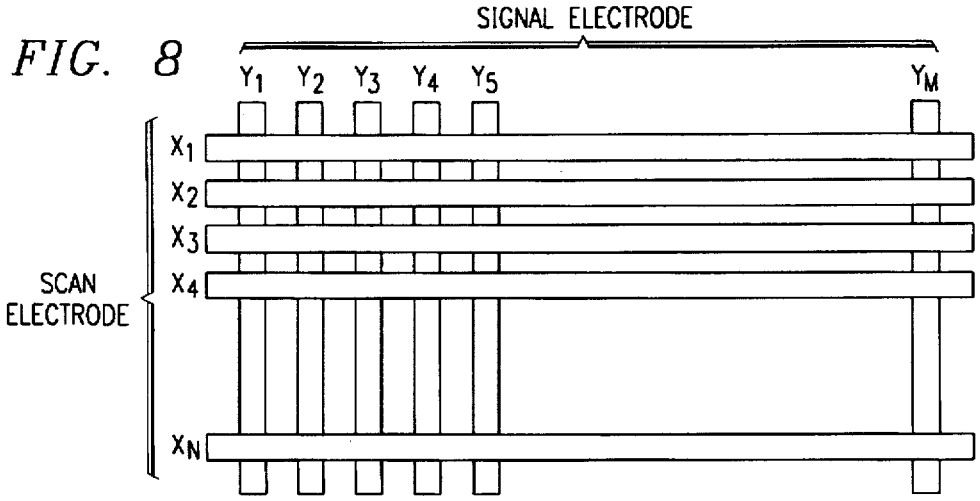
FIG. 8 is a plan view schematically of a simple matrix LCD panel.
Figure 9:
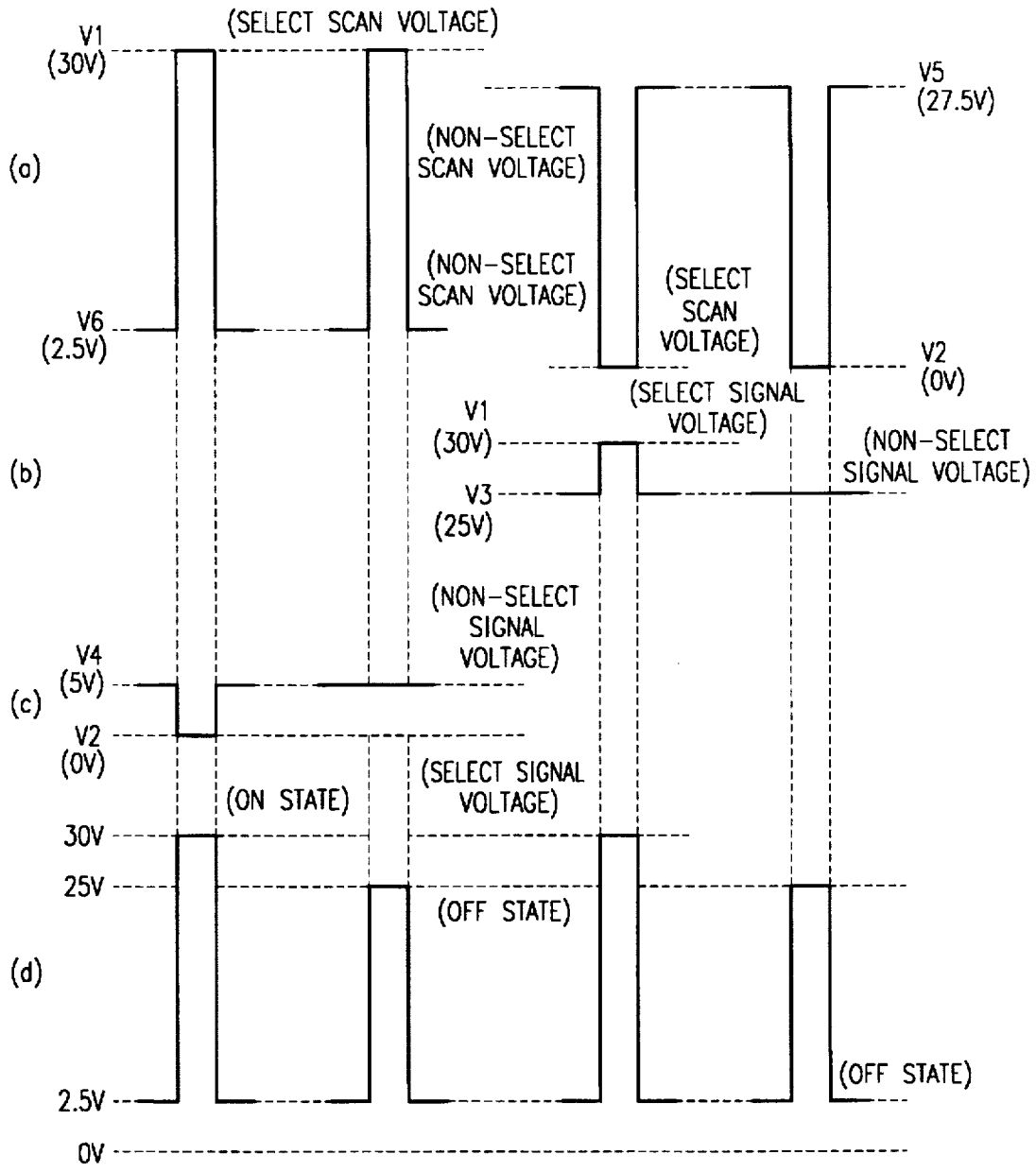
FIG. 9 is a diagram of voltage levels applied to scan electrode X and signal electrode Y for explaining the 6 level drive method.
Figure 10:
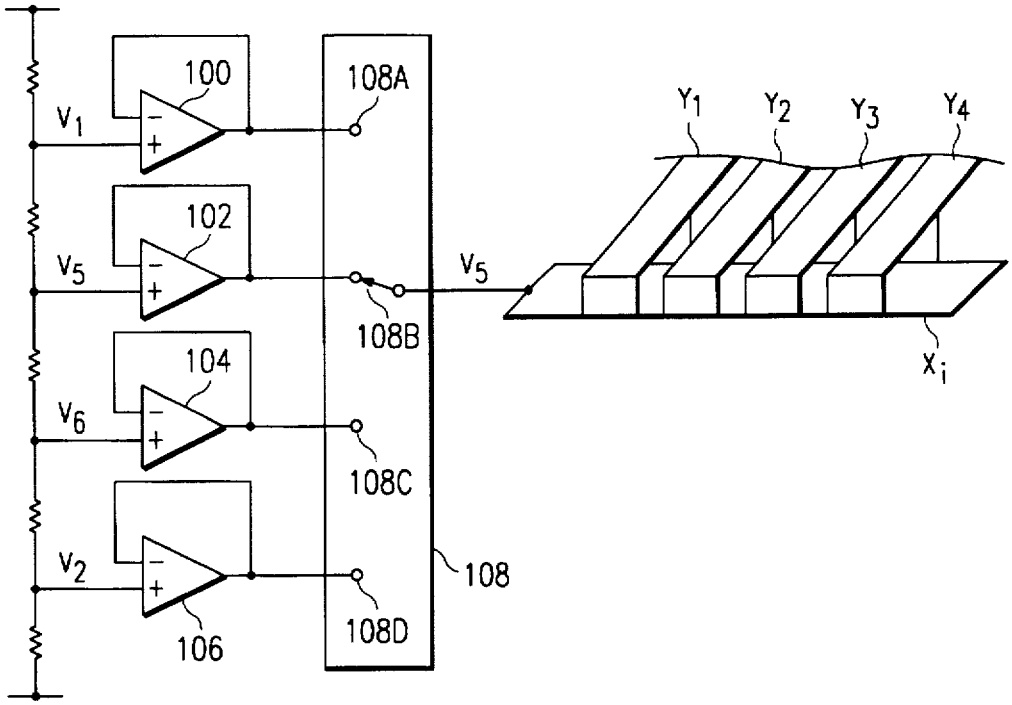
FIG. 10 is a schematic of the main parts of a conventional scan electrode drive circuit.
Figure 11:
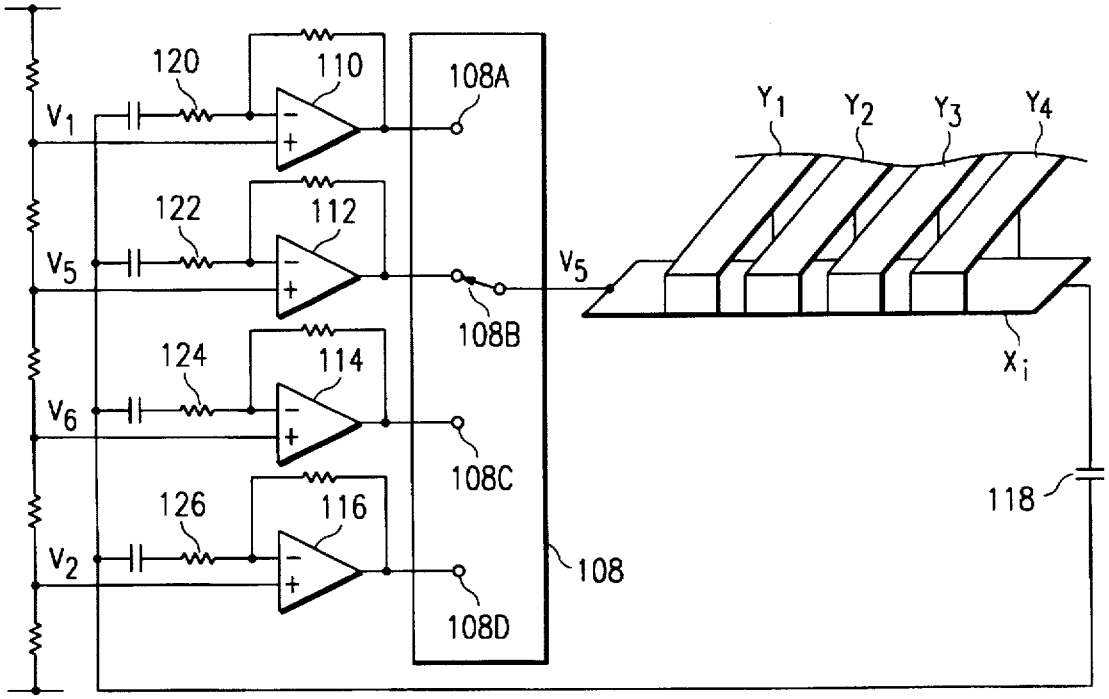
FIG. 11 is a schematic of the main parts of another conventional scan electrode drive circuit.

FIG. 1 shows a liquid crystal display apparatus using an LCD panel drive apparatus which is an embodiment of the present invention. This liquid crystal display apparatus comprises a single matrix LCD panel 10 of the same construction as that shown in FIG. 8, scan electrode drivers C1, . . . . CN and signal electrodes S1, . . . . SM for driving scan electrodes X1~XN and signal electrodes Y1~YM on this LCD panel 10, respectively, controller 12 to control the two drivers C and S, and level shifter 14, which shifts the levels of the signal from controller 12 with respect to scan electrode driver C. Scan electrode drivers C1, . . . . CN and signal electrode drivers S1, . . . . SM are packaged as an IC chip on the TAB tape attached around the perimeter of LCD panel 10.

Figure 2:
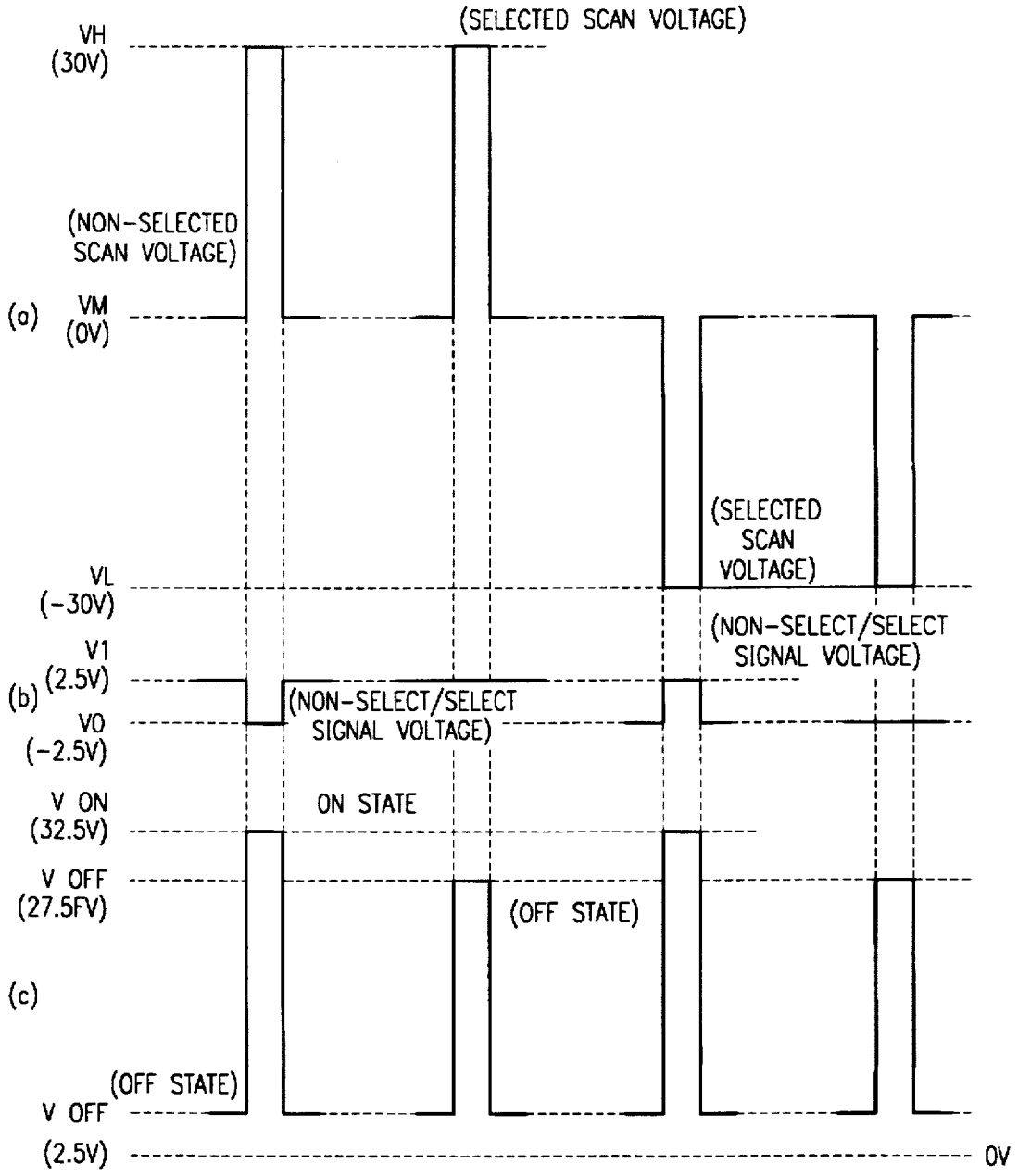
FIG. 2 is a diagram of the voltage levels applied to scan electrode X and signal electrode Y for explaining the 5 level drive method in the embodiment.

The five level drive method using the liquid crystal display apparatus of the present invention is here explained with reference to the voltage waveforms in FIG. 2. To simplify the explanation, we shall assume that the LCD panel 10 display is an ON/OFF (white/black) binary display.

The data output from controller 12 to level shifter 14 and signal electrode driver S is a −2.5V—2.5V logical amplitude signal; the data output from level shifter 14 to scan electrode driver C is, for example, a −30V—25V logic amplitude signal. In other words, level shifter 14 converts the −2.5V—2.5V logic amplitude signal to a −30V—25V logic amplitude signal. Power supply circuit 16 supplies 30V (VEE, VH), 0V (VM), −25V (VDDCOM), and −30V (VL, VSSCOM) voltages to scan electrode driver C, and supplies −2.5V (VSSSEG, V0) and 2.5V (VDDSEG, V1) voltages to signal electrode driver S.

Of the above voltages, the LCD panel drive voltages VH, VM, VL (supplied to scan electrode driver C) and V0, V1 (supplied to signal electrode driver S) are supplied to scan electrode driver C and signal electrode driver S through the power supply operational amplifiers in operational amplifier group 17.

Liquid crystal material immediately degrades when driven by direct current due to the buildup of ions on one side; alternating current drive is required to prevent this. In the five level drive method of the present invention, as shown in FIG. 2(*a*), there are two scan electrode X selecting scan voltages: VH (30V) and VL (−30V). On the other hand, there is only one scan electrode X non-selecting scan voltage: VM (0V). There are two voltages applied to signal electrode Y: V0 (−2.5V) and V1 (2.5V); these become the selecting voltage (pixel ON) or non-selecting voltage (pixel OFF) depending on the voltage applied to scan electrode X.

The signal electrode Y selecting signal voltage is V0 (−2.5V) when the scan electrode X selecting scan voltage is VH (30V), and the selecting signal voltage is V1 (2.5V) when the scan electrode X selecting scan voltage is VL (−30V), so a VON voltage (32.5V) is applied at the position where that scan electrode X and signal electrode Y intersect, and the relevant pixel goes on.

Meanwhile, the signal electrode Y non-selecting signal voltage is V1 (2.5V) when the scan electrode X selecting voltage is VH (30V), and the signal electrode Y non-selecting signal voltage is V0 (−2.5V) when the scan electrode X selecting scan voltage is VL (−30V), so a VOFF (27.5) voltage is applied to the corresponding pixel and the relevant pixel goes off. Also, a voltage V1 (2.5V) or V0 (−2.5V) is applied to each signal electrode Y when a non-selecting scan voltage VM (0V) is applied to scan electrodes X, so a VOFF' voltage (2.5V) is applied to each pixel of unselected scan electrodes X, and the applicable pixels remain in the OFF state.

Thus in the five level drive method, three voltage levels are sufficient for application to LCD panel 10 scan electrodes X, and two voltage levels are sufficient for application to the signal electrode Y, so the construction, control, etc. of scan electrode driver C and signal electrode driver S are simplified. In particular, in signal electrode driver S the circuitry may be formed as solely a 5V circuitry, offering the advantages of reduced IC chip area and lower driver cost.

Looking again at the LCD panel 10 in FIG. 1, in the present invention three dummy electrodes DH, DM, and DL are arrayed parallel to scan electrodes X in the frame area 10*b* outside (above) the video display area 10*a* formed by scan electrodes X1~XN and signal electrodes Y1~YM. Each dummy electrode DH, DM, DL has virtually the same construction (material, dimensions) as scan electrode X, and intersects signal electrodes Y1~YM, sandwiching the liquid crystal. Dummy electrodes DH, DM, and DL are connected to the top edge scan electrode driver C1.

Figure 3:
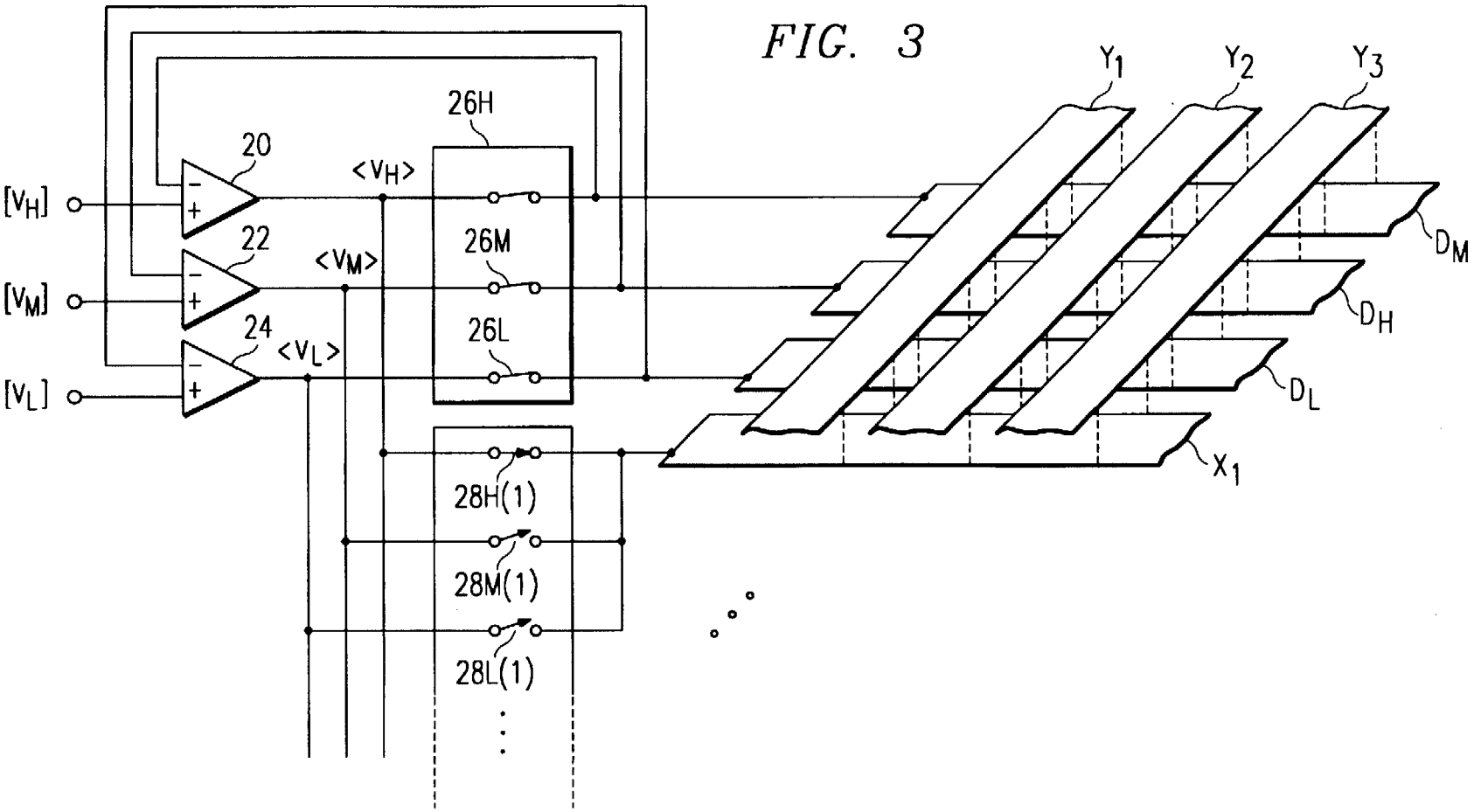
FIG. 3 is a perspective view of the main parts of the embodiment.
Figure 4:
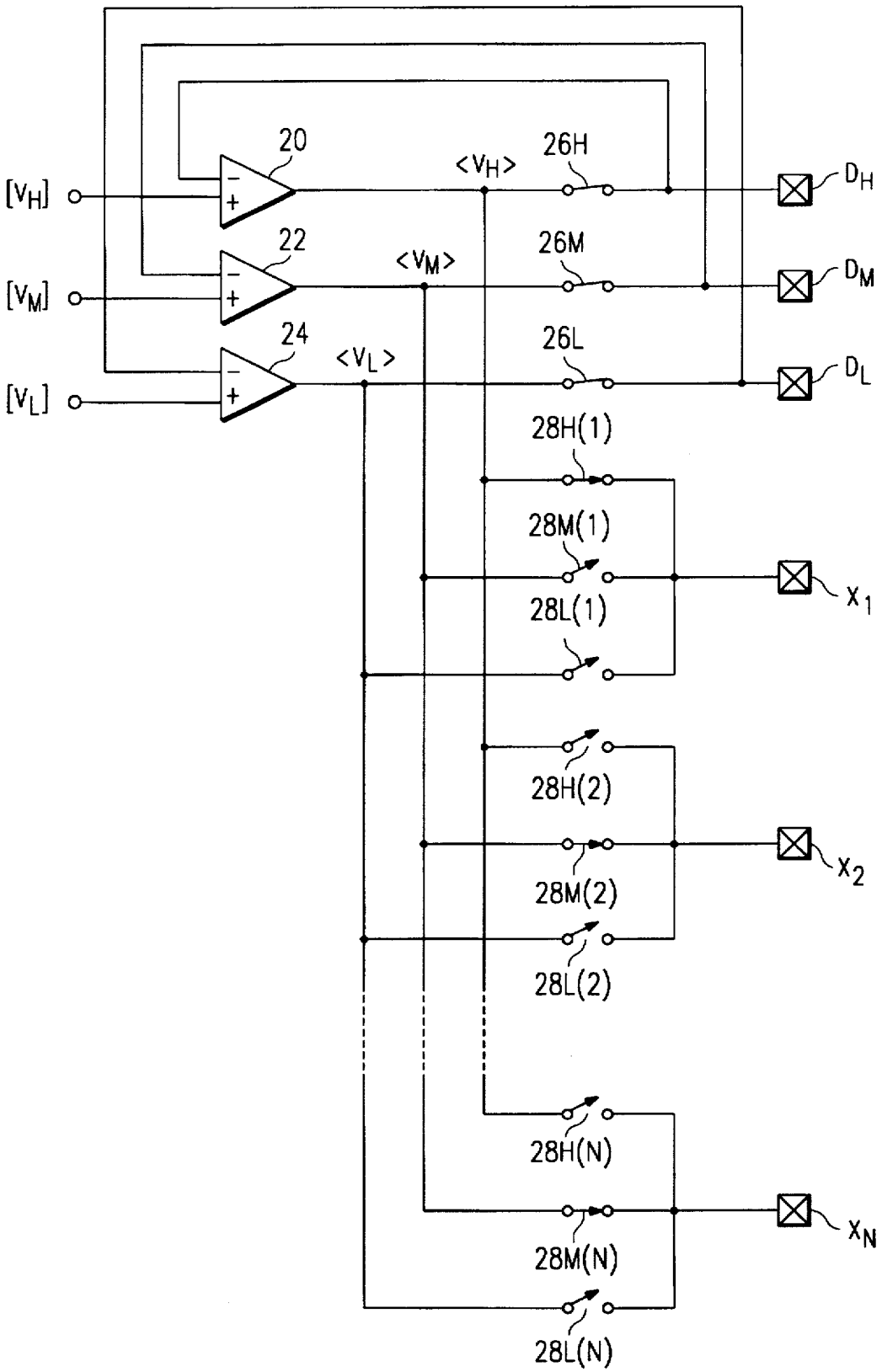
FIG. 4 is a schematic of the main parts of the embodiment.

The structures of the main portions of the liquid crystal display apparatus of the present embodiment are depicted in FIGS. 3 and 4. In the five level method used in the present embodiment, three voltages VH, VM, and VL are alternately applied to scan electrode X, and operational amplifiers 20, 22, and 24 corresponding to those three voltages VH, VM, and VL are provided within operational amplifier group 17. Reference voltages [VH], [VM], and [VL], which determine the selecting scan voltage <VH>, the non-selecting scan voltage <VM>, and the selecting scan voltage <VL> from power supply circuit 16 (FIG. 1) are respectively input to the non-inverting input terminals of operational amplifiers 20, 22, and 24.

The output terminal of operational amplifier 20 is connected to dummy electrode DH through output buffer transistor 26H, while at the same time it is connected to each scan electrode $X_i$ (i=1, 2, . . . , N) through each of the output buffer transistors 28H(i). The output terminal of operational amplifier 22 is connected to dummy electrode DM through output buffer transistor 26M, while at the same time it is connected to each scan electrode $X_i$ through each output buffer transistor 28M(i) . The output terminal of operational amplifier 24 is connected to dummy electrode DL through output buffer transistor 26L while at the same time it is connected to each scan electrode $X_i$ through each output buffer transistor 28L(i). The inverting input terminals of operational amplifiers 20, 22, and 24 are respectively connected to the output terminals of operational amplifiers 20, 22, and 24 through output buffer transistors 26H, 26M, and 26L, while at the same time they are also connected to the dummy electrodes DH, DM, and DL.

The three output buffer transistors 28H(i), 28M(i), and 28L(i), connected in parallel between operational amplifiers 20, 22, and 24 and the scan electrode $X_i$, each have a switching function, and switching control is executed such that one of the output buffer transistors is on and the other two output buffer transistors are OFF, depending on the control signals VGH, VGM, and VGL, in accordance with the scan selecting clock SCK and frame signal M described below.

The three output buffer transistors 26H, 26M, and 26L connected respectively between operational amplifiers 20, 22, and 24 and dummy electrodes DH, DM, and DL have respectively the same constructions as the output buffer transistors 28H(i), 28M(i), and 28L(i) connected to the above scan electrode $X_i$, but none of them has a switching function; they remain in the on (conducting) state at all times by means of the bias described below In this construction, scan electrode $X_i$ is supplied with the output voltage from the operational amplifier connected to the output buffer transistor which is in the ON state through that one of the three output buffer transistors 28H(i), 28M(i), or 28L(i) which is in the ON state.

For example, in FIGS. 3 and 4, when 28H(1) of the output buffer transistors 28H(1), 28M(1), and 28L(1) on the first line scan electrode X1 is on, the selecting scan voltage <VH> is supplied from operational amplifier 20 through this output buffer transistor 28H(1) in the ON state. Meanwhile, operation amplifier 20 output voltage <VH> is supplied to dummy electrode DH as well through output buffer transistor 26H, which is in a constant ON state. In other words, scan electrode X1 and dummy electrode DH are capacitance coupled by the same (liquid crystal) static capacitance as signal electrodes Y1~YM, and the same voltage <VH> is applied from the same operational amplifier 20 through the equivalent output buffer transistors 28H(1) and 26H.

Therefore when a selecting signal electrode Y voltage fluctuates such that even a small amount of distortion is generated in the scan electrode X1 by static coupling induction, the same type of distortion is generated in the dummy electrode DH voltage. This subtle change in the dummy electrode DH voltage is input to the inverting input terminal of operational amplifier 20 as a negative feedback signal, and operational amplifier 20 acts to cancel that voltage change. The negative feedback signal imparted to operational amplifier 20 from dummy electrode DH faithfully expresses the potential fluctuation at scan electrode X1, so that the distortion voltage at scan electrode X1 is effectively suppressed by this type of feedback control, and a specified voltage waveform is maintained without the scan voltage <VH> being affected by inductance from the signal voltage waveform.

When either 28M(1) or 28L(1) of the output buffer transistors 28H(1), 28M(1), and 28L(1) is ON in the first line scan electrode X1 , a negative feedback signal is applied to operational amplifier 22 or 24 by dummy electrode DM or DL, and a specified voltage waveform in the non-selecting voltage <VM> or the selecting voltage <VL> applied to scan electrode X1 is maintained without being affected by inductance from the signal voltage waveform.

With respect to the other scan electrodes X2~XN as well, the fact that dummy electrodes DH, DM, and DL and operational amplifiers 20, 22, and 24 respectively operate in the above manner means that a specified voltage waveform is maintained without the applied signals <VH>, <VM>, and <VL> being affected by inductance from the signal voltage waveform.

In this manner, in the present embodiment even if one of the output buffer transistors 28H(i), 28M(i), or 28L(i) of the scan electrode $X_i$ is ON, a voltage change which is equivalent to the voltage change at scan electrode $X_i$ will appear at dummy electrodes DH, DM, or DL, which are electrically equivalent to scan electrode $X_i$, which is to say equivalent with respect to their static capacitance coupling, applied voltage levels, and buffer transistor impedances with signal electrodes Y1~YM. Since this potential variation is negatively fed back to the common operational amplifiers 20, 22, or 24, a highly accurate feedback control is achieved. By this means, it is possible to effectively eliminate or suppress the effect of inductance from changes in scan electrode X potential caused by changes in signal electrode Y potential due to liquid crystal static capacitance.

Dummy electrodes DH, DM, and DL are positioned on the frame portion 10*b* of LCD panel 10, so they are not visually perceived on the screen.

DH, DM, DL and X1, . . . , XN in FIG. 4 depict the output terminals of scan electrode driver C. This diagram shows the actual circuit schematically. Negative feedback loops in operational amplifiers 20, 22, and 24 are wired to the TAB tape to which scan electrode driver C is attached and to the interconnect substrate to which operational amplifiers 20, 22, and 24 are attached. Also, operational amplifiers 20, 22, and 24 and output buffer transistors 26H, 26M, and 26L may be formed in the same semiconductor integrated circuit, and the negative feedback loop may be wired within that semiconductor integrated circuit.

Figure 5:
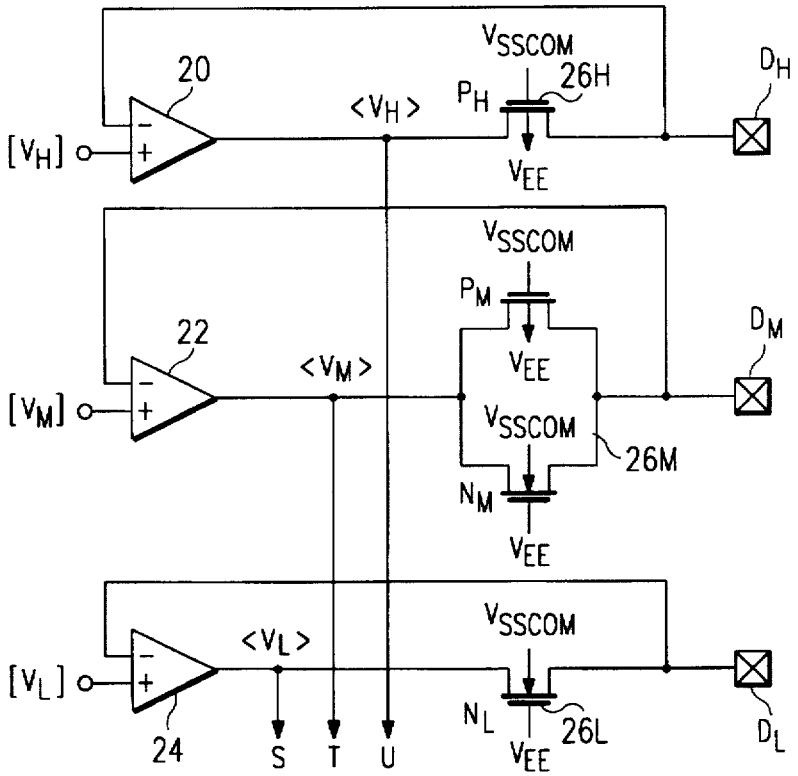
FIG. 5 is a schematic of a specific construction example of the circuitry around the dummy electrode in the embodiment.

FIG. 5 shows the constructions of output buffer transistors 26H, 26M, and 26L connected to dummy electrodes DH, DM, and DL, as well as a concrete example of the bias voltage applied to each transistor.

In this construction example, output buffer transistor 26H is formed of a single P-channel MOS transistor PH; the gate terminal and back gate are respectively biased with VSSCOM (−30V) and VEE (30V), and are in a constant ON state. Output buffer transistor 26M is a pair consisting of a P-channel MOS transistor PM and an N-channel MOS transistor NM; the P-channel MOS transistor PM gate terminal and substrate terminal are respectively biased with VSSCOM (−30V) and VEE (30V), while the N-channel MOS transistor NM gate terminal and substrate terminal are respectively biased with VEE (30V) and VSSCOM (−30V). Both transistors PM and NM are in a constant ON state. Output buffer transistor 26L is formed of a single N-channel MOS transistor NL; its gate terminal and substrate terminal are respectively biased with VEE (30V) and VSSCOM (−30V), and are in a constant ON state.

Figure 6:
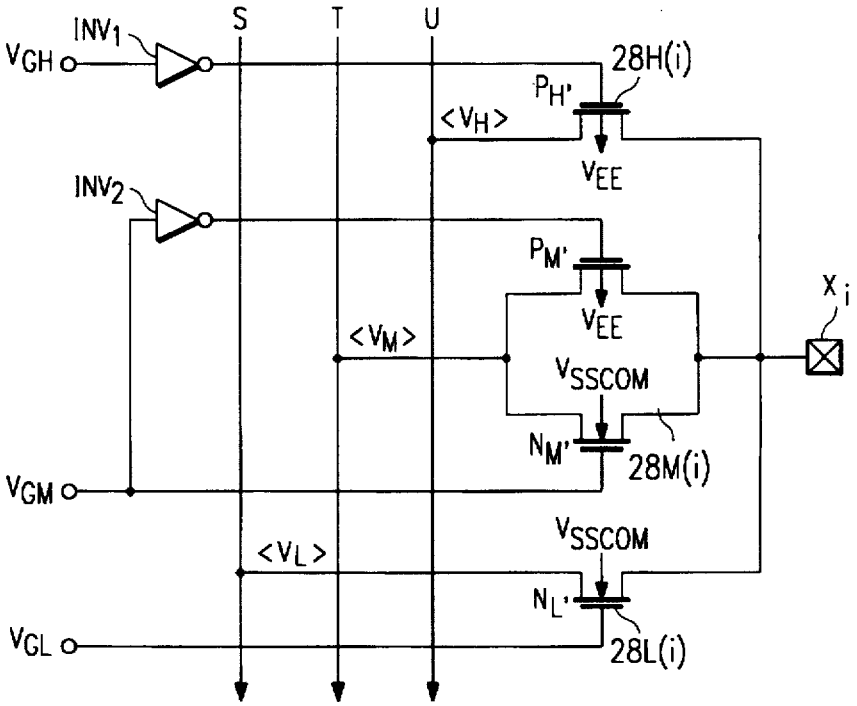
FIG. 6 is a schematic of a specific construction example of the circuitry around the scan electrode in the embodiment.

FIG. 6 shows the constructions of output buffer transistors 28H(i), 28M(i), and 28L(i) connected to scan electrode $X_i$ and a specific example of the bias voltages applied to each transistor.

In this construction example, output buffer transistor 28H(i) is made up of a single P-channel MOS transistor PH'; control signal VGH is applied to the gate terminal thereof through inverting circuit INV1, while the substrate terminal is biased with VEE (30V), and goes ON or OFF in accordance with the control signal VGH voltage level.

Output buffer transistor 28M(i) is made up of a transistor pair consisting of P-channel MOS transistor PM' and N-channel MOS transistor NM'. A control signal VGM is applied to the gate terminal of P-channel MOS transistor PM' through inverting circuit INV2, and the substrate terminal thereof is biased by VEE (30V), turning it ON or OFF in accordance with the control signal VGM voltage level. Control signal VGM is directly applied to the gate terminal of N-channel MOS transistor NM', which is biased on its substrate terminal with VSSCOM (−30V), turning it ON or OFF in accordance with the control signal VGM voltage level.

Output buffer transistor 28L(i) is made up of a single N-channel MOS transistor NL'; control signal VGL is applied to the gate terminal thereof, while the substrate terminal is biased with VSSCOM (−30V), turning it ON or OFF in accordance with the control signal VGL voltage level.

Control signals VGH, VGM, and VGL are generated under the control of controller 12 in each of the scan electrode drivers C. A serial input/parallel output-type shift register with a bit width proportional to the number of scan electrodes X connected to each scan electrode driver C is provided therein; when one pulse of shift register data SIO is input from controller 12, shift register data SIO in the shift register shifts one bit with each falling edge of the shift clock pulse SCK from controller 12. Therefore pointer data with, for example, a logic value of 1 is obtained from just one register in the shift register which stores shift register data SIO, and data having a logic value of 0 is obtained from all other registers.

Meanwhile, a frame signal M is supplied to each scan electrode driver C from controller 12, which inverts the logic values at a fixed cycle, for example every 7 scan lines. The shift register outputs are converted by the subsequent stage selector in accordance with the frame signal M logic value so as to correspond with specified logic values with respect to the signals which respectively correspond to control signals VGH, VGM, and VGL. In other words, the logic value 1 pointer is converted in such a way that when frame signal M is a logical H, the signal corresponding to, for example, control signal VGH has a logic value H, and the signal corresponding to control signal VGH and VGL is a logic value L; other shift registers outputs at logic value 0 are converted in such a way that the signal corresponding, for example, to VGM is a logic value H, and the signal corresponding to control signals VGH and VGL are a logic L, regardless of the logic value of frame signal M.

Level shifters are further provided at subsequent stages of the selector on each scan electrode driver C. In this level shifter, specified voltage control signals VGH, VGM, and VGL are generated based on the logical voltage values (H: −25V, L:−30V) for each signal corresponding to the control signals VGH, VGM, VGL from the selector corresponding to scan electrode $X_i$. In other words, for each scan electrode, the scan electrode $X_i$ is indicated by the above-described pointer data logic value of 1; VGH (30V), VGM (−30V), and VGL (−30V) are generated when −25V, −30V, and −30V are respectively applied as the logic voltage values for each signal corresponding to the control signals VGH, VGM, and VGL from the selector. Scan electrode $X_i$ is indicated by a logic value of 1 in the above pointer data, and VGH (−30V), VGM (−30V), and VGL (30V) are generated when −30V, −30V, and −25V are respectively applied as the logic voltage values for each signal corresponding to the control signals VGH, VGM, and VGL from the selector. Scan electrode $X_i$ will not be indicated when the logic value in the above pointer data is 0, and therefore VGH (−30V), VGM (30V), and VGL (−30V) are generated when −30V, −25V, and −30V are respectively applied as the logic voltage values for each signal corresponding to the control signals VGH, VGM, and VGL from the selector.

In FIG. 6, when the applicable scan electrode $X_i$ is selected (driven) either VGH or VGL of the control signals VGH, VGM, and VGH goes to a logic value H (30V), and the other control signals each goes to L (−30V). The question of which of VGH or VGL goes to a logic H (30V) is determined by the logic value of the frame signal M at the time.

When only VGH is a logic H (30V) and VGM and VGL are a logic L (−30V), only the P-channel MOS transistor PH'—which is to say the output buffer transistor 28H(i)—conducts, and the selecting scan voltage <VH> (30V) from operational amplifier 20 is supplied to scan electrode $X_i$. When only VGL is a logic H (30V) and VGH and VGM are a logic L (−30V), only the N-channel MOS transistor NL'—which is to say the output buffer transistor 28L(i)—conducts, and the selecting scan voltage <VL> (30V) from operational amplifier 24 is supplied to scan electrode $X_i$. When only VGM is a logic H (30V) and VGH and VGL are a logic L (−30V), both of the N-channel and P-channel MOS transistor NM', PM'—which is to say the output buffer transistor 28M(i)—conducts, and the non-selecting scan voltage <VM> (0V) from operational amplifier 22 is supplied to scan electrode $X_i$.

Thus only one of the output buffer transistors 28H(i), 28M(i), and 28L(i) goes to the ON state in accordance the logic value of control signals VGH, VGM, and VGL, and one of the output voltages <VH>, <VM>, or <VL> from the operational amplifier (20, 22, or 24) connected to the output buffer transistor in the ON state is applied to the scan electrode $X_i$. No matter which scan voltage is applied to the scan electrode $X_i$, as was described above, an inductance component equal to the inductance received by scan electrode $X_i$ from the signal voltage waveform is negatively fed back to the relevant operational amplifier (20, 22, or 24) from the dummy electrode DH, DM or DL which is electrically equivalent to the scan electrode $X_i$ at that time; the scan electrode $X_i$ scan voltage is therefore maintained at a specified value and a specified waveform.

Figure 12:
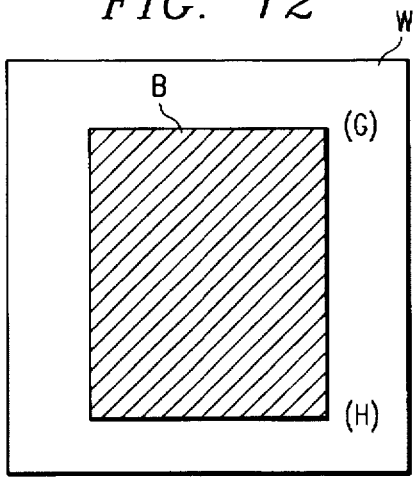
FIG. 12 is a diagram of an example of a displayed pattern for explaining the crosstalk phenomenon which has been a problem with previous technology.
Figure 13:
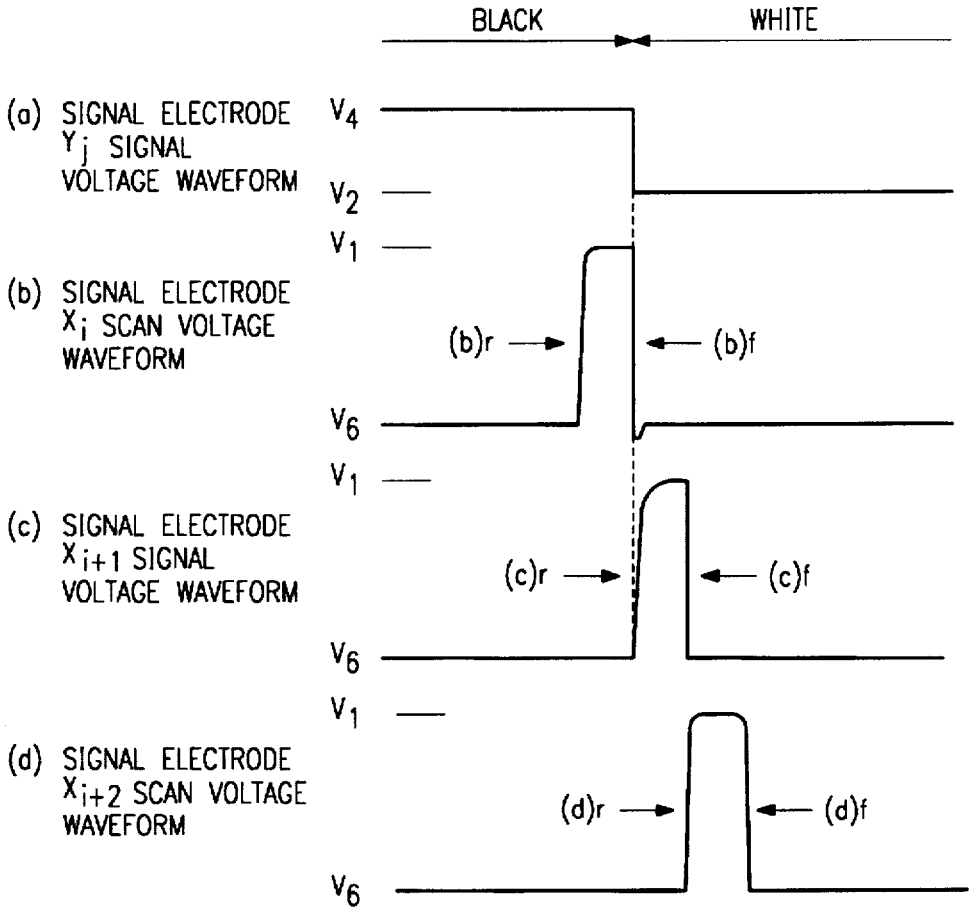
FIG. 13 is a graph of voltage waveforms for explaining the cause of the crosstalk which has been a problem with previous technology.

We next explain the method of the present embodiment for effectively eliminating the crosstalk described above with reference to FIGS. 12 and 13.

In FIG. 1, a liquid crystal drive output control signal EN is applied to scan electrode drivers C1~CN through level shifter 14 from controller 12. When this liquid crystal drive output control signal EN is enabled—for example at a logic H—a scan voltage <VH>, <VM>, or <VL> is output to each scan electrode $X_i$ in a specified selection order from each scan electrode driver Ci. However, when control signal EN is disabled—for example at a logic L—of the control signals VGH, VGM, and VGL at each scan electrode driver Ci, VGM alone is forcibly driven to a logic H (30V), and VGH and VGL to a logic L (−30V); therefore only output buffer transistor 28M(i) is forcibly driven to an ON state, and a non-selecting scan voltage <VM> is applied to each scan electrode $X_i$.

Figure 7:
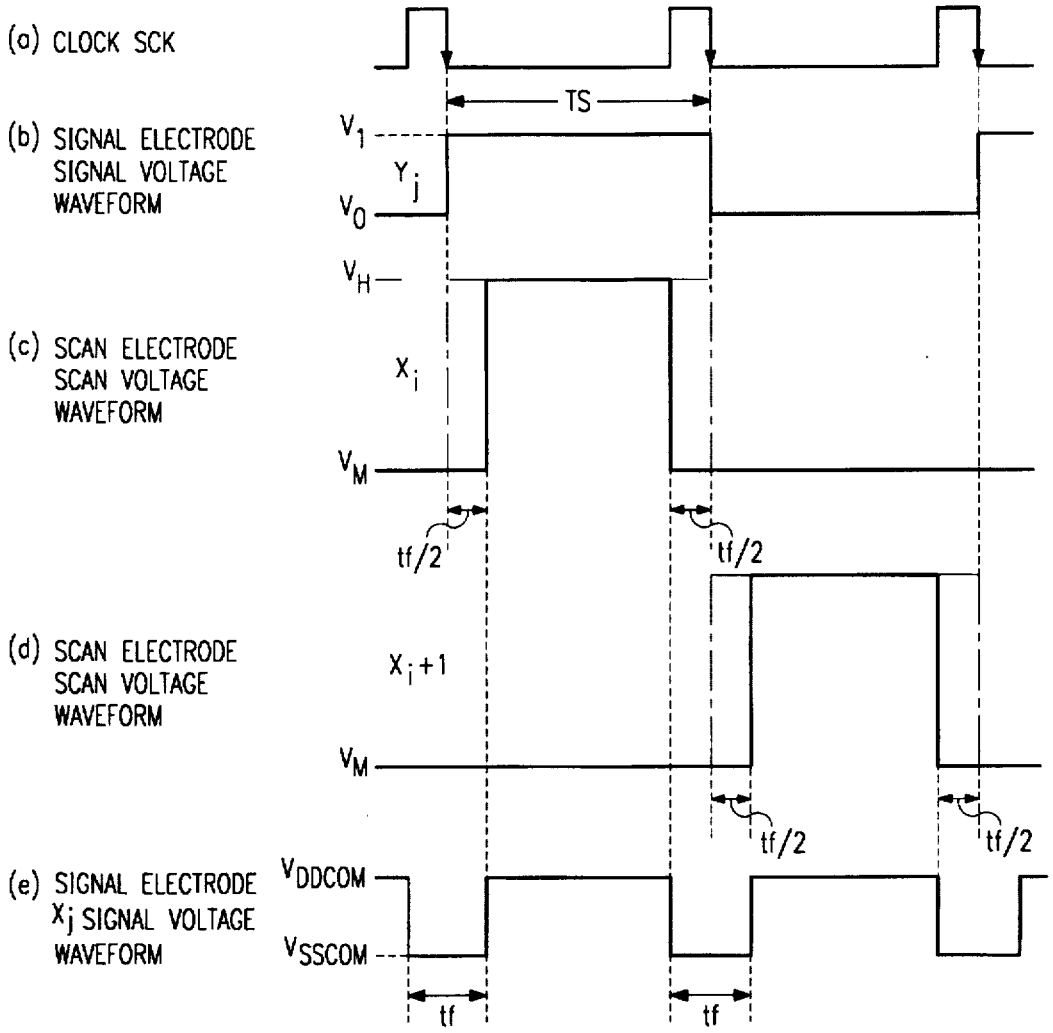
FIG. 7 is a graph of voltage waveforms indicating the control and operation of the liquid crystal drive output control signal EN in the embodiment.

FIG. 7 shows the control and operation of liquid crystal drive output control signal EN in the present embodiment.

In FIG. 7, clock SCK defines scan selecting cycle TS; the selecting period TS for a given scan electrode $X_i$, hitherto selected by each falling edge of SCK, ends, while at the same time the selected time TS with respect to the next scan electrode $X_{i+1}$ begins. Each signal electrode driver S, upon the falling edge of clock SCK, conditionally inverts the logic value of the signal voltage for each signal electrode Y in accordance with the logic value of the video data and frame signal M (FIGS. 7(*a*) and (*b*)).

In the present embodiment, by disabling (logic L) liquid crystal drive output control signal EN for just the specified time tf around the fall of clock SCK at only the beginning and end of each interval, in synchronization with the clock SCK which defines the selected interval for each scan electrode X, while constantly enabling (logic H) EN, the selecting scan voltages <VH> or <VL> in the selecting scan electrode $X_i$ are forced to the non-selecting scan voltage <VM> within that disable time tf (FIG. 7 (c), (d), (e)). By this means, the timing at which selecting scan voltage <VH> or <VL> rises or falls ceases to conform to the timing at which the logic value of the signal voltage changes. Therefore the rise or fall of selecting scan voltage <VH> or <VL> cease to be affected by inductance from the logical inversion of the signal voltage waveform and, as discussed in FIGS. 12 and 13, horizontal dark crosstalk or light crosstalk are effectively suppressed.

We have explained the five level drive method in the embodiment above, but other liquid crystal drive methods may also be used. For example, the present invention can also be implemented by the 6 level drive method, in which 4 voltage values are applied to scan electrode X and 4 voltage values are applied to signal electrode Y. It is preferable in the 6 level drive method to array 4 dummy electrodes D corresponding to the 4 scan voltage values. However, whether using the 5 level drive method or the 6 level drive method, the time (selected time) over which the selecting scan voltage is applied to each scan electrode X is short, and for most of the time (non-selected time), a non-selecting scan voltage is applied. Therefore if the object is to suppress crosstalk caused by inductance from the signal voltage waveform during the non-selecting scan interval, it is possible to provide just a dummy electrode (DM in the above 5 level method embodiment), to which the non-selecting scan voltage is applied.

Furthermore, it is possible to freely select the position in which dummy electrode D is arrayed; for example, it may be arrayed in the frame area below the LCD panel 10 video display area 10*a*. Also, the output buffer transistor structure is not limited to the above-described embodiment; any chosen transistor structure is possible. The output buffer transistor connected to the dummy electrode may be given a switching function as needed. The drive apparatus of the present invention is not limited to STN panels; it may also be applied to MIM panels, TFD panels, etc.

As explained above, the present invention of a liquid crystal drive apparatus provides a dummy electrode electrically equivalent to a scan electrode is provided; by negative feedback from the dummy electrode to an operational amplifier which supplies the scan voltage, the effect of inductance on scan electrode potential from changes in signal electrode potential due to liquid crystal static capacitance can be effectively eliminated or suppressed.

Furthermore, in the liquid crystal drive apparatus of the present invention, offsetting by a specified time the timing of the rise and fall of the selecting scan voltage and the timing of the change in logic value in the signal voltage at the start and end times of the selected interval makes it possible to prevent distortion of the selecting scan voltage waveform caused by logical inversion of the signal voltage waveform, and to effectively suppress crosstalk.

We claim:

1. An LCD panel driver for driving an LCD panel having multiple scan and signal electrodes arrayed in an intersecting matrix so as to sandwich a layer of liquid crystal, a pixel of liquid crystal at each point of intersection of the scan and signal electrodes being ON or OFF in accordance with the absolute value of the difference between the voltages applied to the scan and signal electrodes, said LCD panel driver comprising:

three operation amplifiers each coupable to said scan electrodes, one of said operational amplifiers generating a non-select voltage, the other two operational amplifiers generating select voltages, each operational amplifier being coupled to the scan electrode through a first output buffer transistor, having (i) a non-inverting input terminal for receiving a reference voltage determining the voltage level applied to the scan electrode, (ii) an inverting input terminal, and (iii) an output terminal having a switching function; and three dummy electrodes, in parallel to the scan electrodes, which intersect the multiple signal electrodes and are arrayed to sandwich them, one of said dummy electrodes being coupled to the inverting input terminal of each of said operational amplifiers and to the output terminal through a second output buffer transistor that is (i) equivalent to the first output buffer transistor and (ii) always in an ON state.

2. The LCD panel driver of claim 1 wherein the dummy electrodes have virtually the same construction as the scan electrodes and are arrayed on the outside of the LCD panel.

3. An LCD panel driver for driving an LCD panel having multiple scan and signal electrodes arrayed in an intersecting matrix so as to sandwich a layer of liquid crystal, the pixel of liquid crystal at each point of intersection of the scan and signal electrodes being ON or OFF in accordance with the absolute value of the difference between the voltages applied to the scan an signal electrodes, said LCD panel driver comprising:

a scan electrode drive circuit which applies a selecting scan voltage to at least one of the scan electrodes at a fixed selected interval while at the same time applying a non-selecting scan voltage to all other scan electrodes;

a signal electrode drive circuit which applies to each of the signal electrodes a signal voltage based on the pixel data for each pixel on the scan electrodes, to which are applied the selecting scan voltages at the selected interval; and means for offsetting by a specified time the time at which the selecting scan voltage rises and falls at the start and termination of the selected interval and the time at which the signal voltage logic value changes wherein the rise and fall of said scan voltage are substantially unaffected by changes in said signal voltage whereby horizontal dark cross talk or light crosstalk are suppressed.

* * * * *